US010863293B2

(12) United States Patent
Yan et al.

(10) Patent No.: US 10,863,293 B2
(45) Date of Patent: Dec. 8, 2020

(54) ELECTRO-ACOUSTIC CONVERSION DEVICE AND TERMINAL

(71) Applicants: GUANGDONG OPPO MOBILE TELECOMMUNICATIONS CORP., LTD., Guangdong (CN); KING TONE INNOVATION (BEIJING) TECHNOLOGY CO., LTD., Beijing (CN)

(72) Inventors: Bixiang Yan, Guangdong (CN); Xin Yan, Guangdong (CN)

(73) Assignees: GUANGDONG OPPO MOBILE TELECOMMUNICATIONS CORP., LTD., Guangdong (CN); KING TONE INNOVATION (BEIJING) TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 16/674,865

(22) Filed: Nov. 5, 2019

(65) Prior Publication Data

US 2020/0068327 A1 Feb. 27, 2020

Related U.S. Application Data

(63) Continuation of application No. PCT/CN2018/085507, filed on May 3, 2018.

(30) Foreign Application Priority Data

May 24, 2017 (CN) ..... 2017 1 0375607
May 24, 2017 (CN) ..... 2017 2 0595690 U

(51) Int. Cl.
*H04R 29/00* (2006.01)
*H04R 1/02* (2006.01)
(Continued)

(52) U.S. Cl.
CPC ..... *H04R 29/001* (2013.01); *H04R 1/025* (2013.01); *H04R 3/00* (2013.01); *H04R 17/00* (2013.01); *H04R 2499/11* (2013.01)

(58) Field of Classification Search
None
See application file for complete search history.

(56) References Cited

U.S. PATENT DOCUMENTS 9,363,589 B2 * 6/2016 Lippert ..... H04R 1/023
10,209,123 B2 * 2/2019 Vitt ..... H04R 29/001
(Continued)

FOREIGN PATENT DOCUMENTS

CN 2216668 1/1996
CN 201104001 8/2008
(Continued)

OTHER PUBLICATIONS

WIPO, ISR for PCT/CN2018/085507, Jul. 25, 2018.
EPO, Office Action for EP Application No. 18805013.2, dated Apr. 22, 2020.

*Primary Examiner* — Paul W Huber
(74) *Attorney, Agent, or Firm* — Hodgson Russ LLP

(57) ABSTRACT

The present disclosure discloses an electro-acoustic conversion device and a terminal. The electro-acoustic conversion device includes a housing, an electro-acoustic component, and a vibration element. The housing is provided with a sound chamber and a sound outlet communicating with the sound chamber. The electro-acoustic component is arranged in the sound chamber. The vibration element is fixed to the housing and configured to generate sound waves to atomize liquid in the sound chamber, so that the atomized liquid is discharged outside the sound chamber through the sound outlet.

20 Claims, 2 Drawing Sheets

(51) Int. Cl.
*H04R 3/00* (2006.01)
*H04R 17/00* (2006.01)

(56) References Cited

U.S. PATENT DOCUMENTS

| | | | | |
|---|---|---|---|---|
| 2015/0163572 | A1* | 6/2015 | Weiss | H04R 1/2876 381/337 |
| 2015/0319534 | A1 | 11/2015 | Lippert et al. | |
| 2016/0241945 | A1* | 8/2016 | Zadesky | H04R 29/00 |
| 2018/0084324 | A1* | 3/2018 | Vitt | H04R 9/025 |

FOREIGN PATENT DOCUMENTS

| | | |
|---|---|---|
| CN | 103056061 | 4/2013 |
| CN | 204014039 | 12/2014 |
| CN | 104954901 | 9/2015 |
| CN | 105222347 | 1/2016 |
| JP | S5912687 | 1/1984 |
| JP | 2012057842 | 3/2012 |

* cited by examiner

ELECTRO-ACOUSTIC CONVERSION DEVICE AND TERMINAL

CROSS-REFERENCE TO RELATED APPLICATIONS

The present application is a continuation of International Application No. PCT/CN2018/085507, filed on May 3, 2018, which claims priority to Chinese Patent Application Nos. 201720595690.9 and 201710375607.1, each filed on May 24, 2017. The entire disclosures of the aforementioned applications are incorporated herein by reference.

TECHNICAL FIELD

The present disclosure relates to the technology field of electronic devices, and more particularly to an electro-acoustic conversion device and a terminal.

BACKGROUND

When liquid is introduced into a sound chamber of an electronic device such as a mobile phone having an electro-acoustic component (for example, a speaker), if the liquid is not discharged in time, normal operation of the electro-acoustic component may be affected.

SUMMARY

The present disclosure provides an electro-acoustic conversion device and a terminal.

The electro-acoustic conversion device according to an implementation of the present disclosure includes a housing, an electro-acoustic component, and a vibration element. The housing is provided with a sound chamber and a sound outlet communicating with the sound chamber. The electro-acoustic component is arranged in the sound chamber. The vibration element is fixed to the housing and configured to generate sound waves to atomize liquid in the sound chamber, to discharge the atomized liquid outside the sound chamber through the sound outlet.

In some implementations, the vibration element is further configured to drive the housing to vibrate together when the vibration element vibrates.

In some implementations, the sound chamber includes a rear sound chamber and a front sound chamber communicating with the rear sound chamber. The electro-acoustic component is housed in the rear sound chamber, and the sound outlet communicates with the front sound chamber.

In some implementations, the housing includes a rear housing and a front housing. The rear housing is connected to the front housing, the rear housing encloses the rear sound chamber, and the front housing encloses the front sound chamber. The electro-acoustic component is arranged in the rear housing, and the vibration element is fixed to the front housing.

In some implementations, the front housing includes a vibration sheet opposite to a sound emitting side of the electro-acoustic component. The vibration element is fixed to the vibration sheet.

In some implementations, the vibration element is a piezoelectric ceramic piece.

In some implementations, the vibration sheet is a steel sheet.

In some implementations, the vibration element is located within the front sound chamber or outside the front sound chamber.

In some implementations, the front housing is of an integral structure.

In some implementations, the sound outlet is formed by a common definition of the front housing and the rear housing.

In some implementations, high-frequency sound waves having frequency greater than 6000 Hz are generated during the vibration of the vibration element and the housing.

In some implementations, ultrasonic waves having frequency of 20000 Hz or more are generated during the vibration of the vibration element and the housing.

The terminal according to an implementation of the present disclosure includes a casing and the electro-acoustic conversion device of any of the above implementations. The casing is provided with at least one speaker hole. The electro-acoustic conversion device is arranged in the casing, and the sound outlet is in communication with the speaker hole.

In some implementations, the terminal includes: a detection module configured to detect whether there is liquid in the sound chamber; and a processor configured to control the vibration element to vibrate to generate sound waves when there is liquid in the sound chamber, to atomize the liquid in the sound chamber.

In some implementations, the detection module is configured to detect an impedance curve of the electro-acoustic component, determine whether the impedance curve matches a preset impedance curve, and determine that there is liquid in the sound chamber when the impedance curve does not match the preset impedance curve.

In the above electro-acoustic conversion device and the terminal, the vibration element vibrates during operation to generate sound waves to atomize the liquid in the sound chamber, and then discharges the atomized liquid from the sound chamber, thus ensuring the normal operation of the electro-acoustic conversion device.

The additional aspects and advantages of the present disclosure will be given in the following description, and will become apparent from the following description, or will be understood through implementing the present disclosure.

BRIEF DESCRIPTION OF THE DRAWINGS

The above and/or additional aspects and advantages of the present disclosure will become apparent and readily understood from the description of the implementations in conjunction with the following drawings.

DESCRIPTION OF SYMBOLS OF MAIN COMPONENTS

Figure 1:
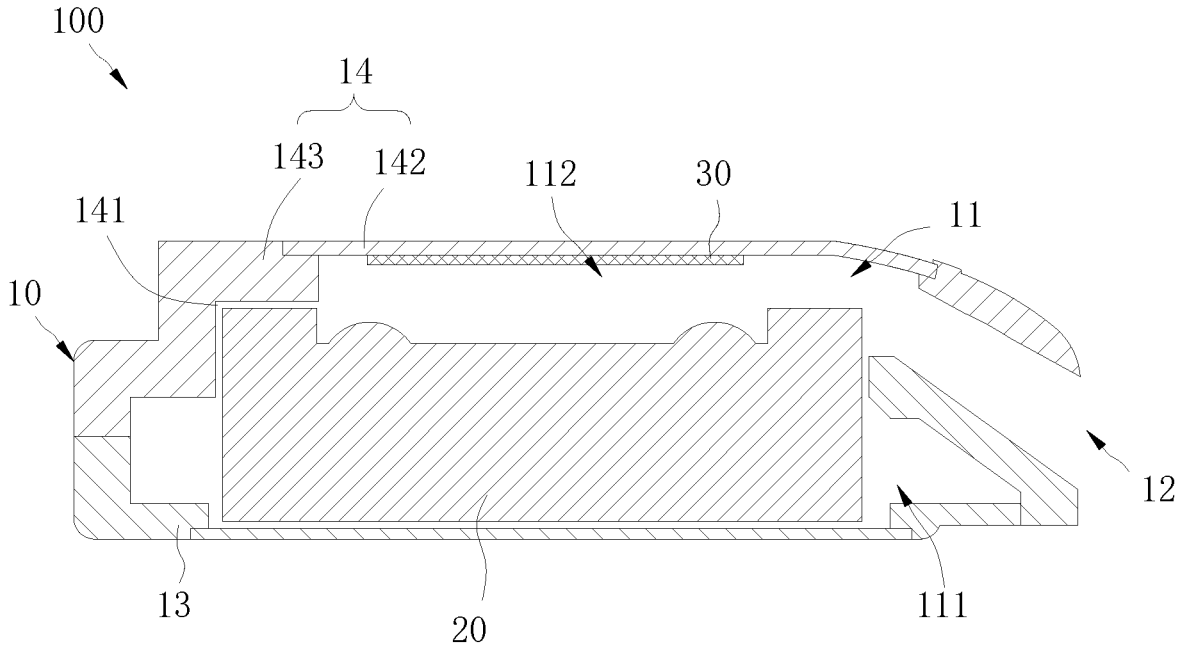
FIG. 1 is a cross-sectional schematic diagram of an electro-acoustic conversion device according to an implementation of the present disclosure.

Electro-acoustic conversion device 100, housing 10, sound chamber 11, rear sound chamber 111, front sound chamber 112, sound outlet 12, rear housing 13, front housing 14, limiting portion 141, vibration sheet 142, connecting portion 143, electro-acoustic component 20, vibration element 30; terminal 200, casing 202, speaker hole 204, detection module 210, processor 220, circuit board 230, memory 240, and power supply circuit 250.

DETAILED DESCRIPTION

The implementations of the present disclosure are described in detail below, and examples of the implementations are illustrated in the drawings, where the same or similar reference numerals indicate the same or similar elements or elements having the same or similar functions. The implementations described below with reference to the drawings are intended to be illustrative of the present disclosure, but are not to be construed as limiting.

In the description of the present disclosure, it is to be understood that orientations or positional relationships indicated by the terms "center", "longitudinal", "lateral", "length", "width", "thickness", "up", "down", "front", "rear", "left", "right", "vertical", "horizontal", "top", "bottom", "inside", "outside", "clockwise", "counterclockwise", etc., are based on the orientations or positional relationships illustrated in the drawings, and are merely for the convenience of the description of the present disclosure and simplifying the description, rather than indicating or implying that the devices or components referred to must have a specific orientation, be constructed and operated in a specific orientation. Therefore, it should not be construed as limiting the present disclosure. Moreover, the terms "first" and "second" are used for descriptive purposes only and cannot to be construed as indicating or implying a relative importance or implicitly indicating the number of technical features indicated. Thus, features defined as "first" or "second" may include one or more of the described features either explicitly or implicitly. In the description of the present disclosure, the meaning of "a plurality of/multiple" is two or more, unless otherwise specifically defined.

In the description of the present disclosure, it should be noted that, unless otherwise specified and defined, the terms "mounted", "connected", and "connection" should be understood broadly. For example, they may be a fixed connection, a detachable connection, or an integrated connection. Alternatively, they may be a mechanical connection, an electrical connection, or communication with each other. Alternatively, they may be directly connected, indirectly connected through intermediaries, or an internal communication of two components or an interaction between two components. For those skilled in the art, the specific meanings of the above terms in the present disclosure may be understood according to specific circumstances.

In the present disclosure, unless otherwise specified and defined, a first feature "on" or "under" a second feature may include direct contact between the first and second features, and may also include that the first and second features are not in direct contact but are contacted through additional features between them. Moreover, the first feature "above", "over" and "on top of" the second feature includes the first feature directly above and indirectly above the second feature, or merely indicates that the level of the first feature is higher than that of the second feature. The first feature "below", "under" and "at the bottom of" the second feature includes the first feature directly below and indirectly below the second feature, or merely indicates that the level of the first feature is lower than the second feature.

The following disclosure provides many different implementations or examples for implementing different structures of the present disclosure. In order to simplify the disclosure of the present disclosure, the components and arrangements of the specific examples are described below. Of course, they are merely examples and are not intended to limit the invention. In addition, the present disclosure may be repeated with reference to the numerals and/or reference letters in various examples, which are for the purpose of simplicity and clarity, and do not indicate the relationship between the various implementations and/or arrangements discussed. Moreover, the present disclosure provides examples of various specific processes and materials, but those of ordinary skill in the art may be aware of the application of other processes and/or the use of other materials.

The implementation of the present disclosure provides an electro-acoustic conversion device which includes a housing, an electro-acoustic component and a vibration element. The housing is provided with a sound chamber and a sound outlet communicating with the sound chamber. The electro-acoustic component is arranged in the sound chamber. The vibration element is fixed to the housing and configured to generate sound waves to atomize liquid entering the sound chamber, to discharge the atomized liquid outside the sound chamber through the sound outlet.

The implementation of the present disclosure further provides a terminal which includes a casing and the above electro-acoustic conversion device. The casing is provided with at least one speaker hole. The electro-acoustic conversion device is arranged in the casing, and the sound outlet is in communication with the speaker hole.

Referring to FIG. 1, an electro-acoustic conversion device 100 according to an implementation of the present disclosure includes a housing 10, an electro-acoustic component 20, and a vibration element 30. The housing 10 is provided with a sound chamber 11 and a sound outlet 12 communicating with the sound chamber 11. The electro-acoustic component 20 is arranged in the sound chamber 11. The vibration element 30 is fixed to the housing 10, and configured to generate sound waves to atomize liquid in the sound chamber 11, so that the atomized liquid is discharged outside the sound chamber 11 through the sound outlet 12.

In the electro-acoustic conversion device 100, the vibration element 30 vibrates during operation to generate sound waves to atomize the liquid in the sound chamber 11, and then discharges the atomized liquid from the sound chamber 11, thus ensuring the normal operation of the electro-acoustic component 20. In addition, since the vibration element 30 is fixed to the housing 10, the vibration element 30 may drive the housing 10 to vibrate together when the vibration element 30 vibrates, so that more sound waves may be generated to improve the atomization speed of the liquid in the sound chamber 11.

Specifically, the vibration element 30 is fixed to the housing 10 by bonding for example. After the vibration element 30 is powered on, the vibration element 30 vibrates due to exciting force generated by piezoelectric effect. When the vibration element 30 vibrates, the vibration element 30 may drive the housing 10 to vibrate together. High-frequency sound waves having frequency greater than 6000 Hz for example, may be generated during the vibration of the vibration element 30 and the housing 10. Ultrasonic waves having frequency of 20000 Hz or more may be even generated during the vibration of the vibration element 30 and the housing 10. Cavitation phenomenon occurs when the sound waves propagate through the liquid in the sound chamber 11, which causes cavity explosion between the liquid and air, to pulverize the liquid around the cavity into tiny liquid particles to form liquid mist, so that an atomization effect of the liquid can be achieved. The electro-acoustic component 20 is a component in an electronic device, such as a loudspeaker, a microphone, an earpiece, a loudspeaker in an earphone, etc.

In one example, the vibration element 30 is a piezoelectric ceramic piece. In this way, vibration time and vibration frequency of the piezoelectric ceramic piece can be easily controlled because the piezoelectric ceramic piece is easy to control, so that the atomization effect of the liquid in the sound chamber 11 can be improved.

It can be understood that, the sound outlet 12 communicates the sound chamber 11 with an outside of the housing 10.

In some implementations, the sound chamber 11 includes a rear sound chamber 111 and a front sound chamber 112 communicating with the rear sound chamber 111. The electro-acoustic component 20 is housed in the rear sound chamber 111, and the sound outlet 12 communicates with the front sound chamber 112.

In this way, the sound generated by the electro-acoustic component 20 can smoothly pass through the front sound chamber 112 and then pass out of the sound outlet 12 to the outside of the housing 10.

In some implementations, the housing 10 includes a rear housing 13 and a front housing 14. The rear housing 13 is connected to the front housing 14, the rear housing 13 encloses the rear sound chamber 111, and the front housing 14 encloses the front sound chamber 112. The electro-acoustic component 20 is arranged in the rear housing 13, and the vibration element 30 is fixed to the front housing 14.

Since the sound outlet 12 communicates with the front sound chamber 112, liquid may easily enter the front sound chamber 112 from the sound outlet 12. Thus, the fixing of the vibration element 30 to the front housing 14 can shorten the distance between the vibration element 30 and the liquid in the front sound chamber 112, and the sound waves generated by the vibration element 30 is less lost, which can improve the atomization effect of the liquid in the front sound chamber 112. Moreover, the housing 10 is composed of two parts, so that the housing 10 can be easily formed.

Specifically, the rear housing 13 and the front housing 14 may be formed separately, and the rear housing 13 and the front housing 14 may be assembled to form the housing 10. The front housing 14 is provided with a limiting portion 141. The limiting portion 141 matches an outer shape of the electro-acoustic component 20, to limit the position of the electro-acoustic component 20 within the sound chamber 11. In the present implementation, the limiting portion 141 is a right-angled groove which matches an edge of the electro-acoustic component 20. The electro-acoustic component 20 is arranged in the rear housing 13 by bonding for example.

In some implementations, the front housing 14 includes a vibration sheet 142. The vibration sheet 142 is opposite to a sound emitting side of the electro-acoustic component 20, and the vibration element 30 is fixed to the vibration sheet 142.

When the liquid enters the front sound chamber 112, the electro-acoustic component 20 is wet, especially a diaphragm of the electro-acoustic component 20 is wet, which affects the operational performance of the electro-acoustic component 20. It can be understood that, the diaphragm of the electro-acoustic component 20 is located at the sound emitting side of the electro-acoustic component 20. Therefore, the vibration sheet 142 can make the vibration element 30 oppose the diaphragm of the electro-acoustic component 20, then the sound waves generated by the vibration element 30 can effectively atomize the liquid on the diaphragm of the electro-acoustic component 20, so as to dry the diaphragm of the electro-acoustic component 20, thereby ensuring the operational performance of the electro-acoustic component 20.

Specifically, the front housing 14 further includes a connecting portion 143 connected to the vibration sheet 142, and the vibration sheet 142 may be embedded in the connecting portion 143. In other words, the connecting portion 143 surrounds the vibration sheet 142. The connecting portion 143 is connected to the rear housing 13.

In some implementations, the vibration sheet 142 is a steel sheet. In this way, the vibration sheet 142 may easily resonate with the vibration element 30 to increase the generation of the sound waves.

In some implementations, as illustrated in FIG. 1, the vibration element 30 is located within the front sound chamber 112.

In this way, the sound waves generated by the vibration element 30 are less lost during propagating to the liquid, which can improve the atomization effect of the liquid.

Figure 2:
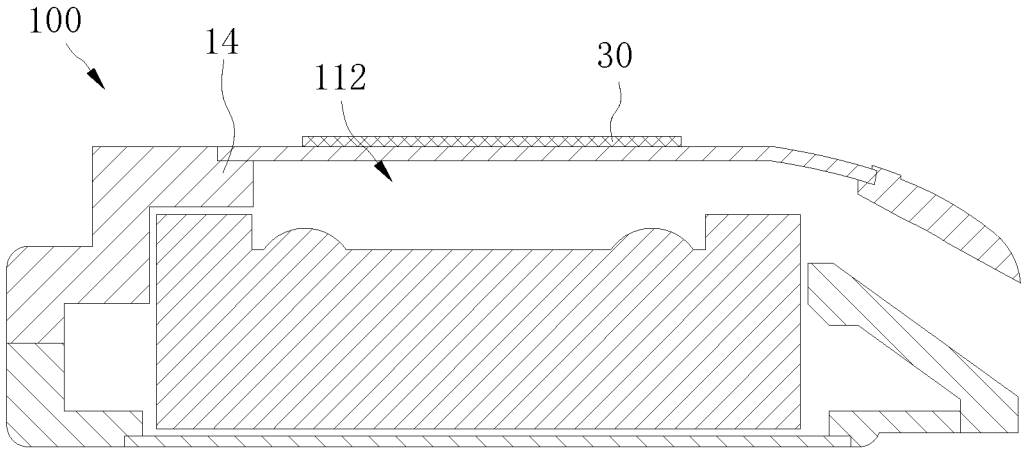
FIG. 2 is another cross-sectional schematic diagram of the electro-acoustic conversion device according to an implementation of the present disclosure.

Of course, in some implementations, as illustrated in FIG. 2, the vibration element 30 may also be located outside the front sound chamber 112.

In some implementations, the front housing 14 is of an integral structure. For example, the front housing 14 may be formed into the integral structure by an in-mold injection process using plastics, which makes the front housing 14 easy to form, and reduces the manufacturing cost of the housing 10.

In some implementations, the sound outlet 12 is formed by a common definition of the front housing 14 and the rear housing 13. In this way, neither the front housing 14 nor the rear housing 13 need to be separately provided with a through hole as the sound outlet 12, which makes the front housing 14 and the rear housing 13 easier to manufacture and form.

Figure 3:
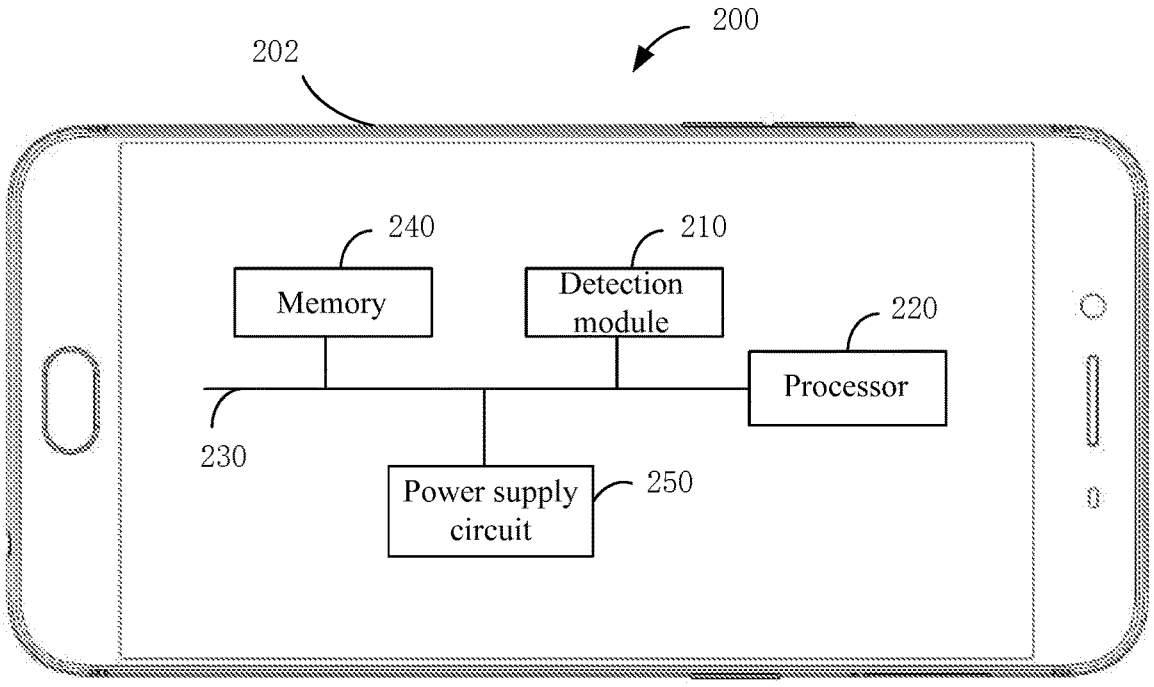
FIG. 3 is a front schematic diagram of a terminal according to an implementation of the present disclosure.
Figure 4:
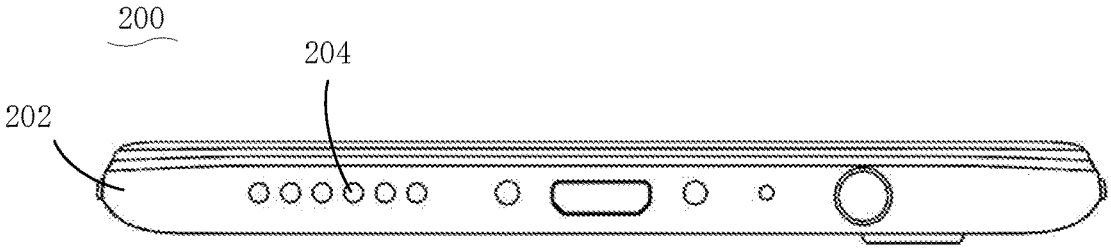
FIG. 4 is a bottom schematic diagram of a terminal according to an implementation of the present disclosure.

Referring to FIGS. 3 and 4, the terminal 200 according to the implementation of the present disclosure includes a casing 202 and the electro-acoustic conversion device 100 of any of the above implementations. The casing 202 is provided with a speaker hole 204. The electro-acoustic conversion device 100 is arranged in the casing 202, and the sound outlet 12 is in communication with the speaker hole 204. The terminal 200 is a mobile terminal, such as a mobile phone or a tablet computer, which has the electro-acoustic component 20.

In this way, the vibration element 30 vibrates during operation to generate sound waves to atomize the liquid in the sound chamber 11, and then discharges the atomized liquid from the sound chamber 11, thus ensuring the normal operation of the electro-acoustic component 20, and further ensuring the normal operation of the terminal 200. Specifically, the sound generated by the electro-acoustic component 20 can be transmitted to the outside of the terminal 200 through the speaker hole 204, so that an user can hear the sound emitted by the electro-acoustic component 20. The user can use the terminal 200 to play songs, and listen to the tune of the song played by the electro-acoustic component 20 to please his body and mind.

Specifically, in the present implementation, the number of the speaker holes 204 is plural, and a plurality of the speaker holes 204 are arranged at intervals along the same straight line.

In some implementations, the terminal 200 includes a detection module 210 and a processor 220. The detection module 210 is configured to detect whether there is liquid in the sound chamber 11. The processor 220 is configured to control the vibration element 30 to vibrate to generate sound waves when there is liquid in the sound chamber 11, thereby atomizing the liquid in the sound chamber 11.

In this way, the terminal 200 can automatically detect whether there is liquid in the sound chamber 11, and atomize the liquid and discharge the atomized liquid to the outside of the sound chamber 11 when there is liquid in the sound chamber 11.

In some implementations, the detection module 210 is configured to detect an impedance curve of the electro-acoustic component 20, determine whether the impedance curve matches a preset impedance curve, and determine that there is liquid in the sound chamber 11 when the impedance curve does not match the preset impedance curve.

When there is liquid in the sound chamber 11, the diaphragm of the electro-acoustic component 20 is pressed, which makes an amplitude of the diaphragm of the electro-acoustic component 20 smaller, thus making the impedance of the electro-acoustic component 20 change. Therefore, an impedance curve of the electro-acoustic component 20 during normal operation can be pre-stored in the terminal 200 as the preset impedance curve. The detection module 210 compares the detected impedance curve of the electro-acoustic component 20 during operation with the preset impedance curve to determine whether there is liquid in the sound chamber 11.

It should be noted that, the impedance curve detected by the detection module 210 matching the preset impedance curve, means that the impedance curve detected by the detection module 210 may be substantially the same as the preset impedance curve, and the impedance curve detected by the detection module 210 does not necessarily coincide with the preset impedance curve.

Figure 5:
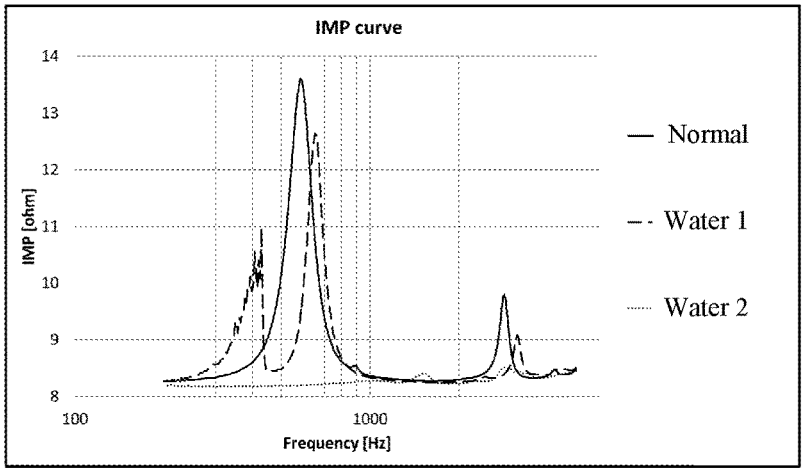
FIG. 5 is a schematic diagram showing an impedance curve of an electro-acoustic component according to an implementation of the present disclosure.

In one example, the impedance curves of the electro-acoustic component 20 are illustrated in FIG. 5 when there is liquid and no liquid (i.e., normal) in the sound chamber 11. It can be seen from FIG. 5 that, when there is liquid and no liquid in the sound chamber 11, there is difference between the impedance curves of the electro-acoustic component 20. Therefore, whether or not there is liquid in the sound chamber 11 can be detected according to the difference between the impedance curves of the electro-acoustic component 20.

Specifically, referring to FIG. 3, the terminal 200 further includes a circuit board 230, a memory 240, and a power supply circuit 250. The circuit board 230 is arranged in the casing 202, and the processor 220 and the memory 240 are arranged on the circuit board 230. The power supply circuit 250 is configured to supply power for various circuits or devices of the terminal 200.

In the description of this specification, the description with reference to the terms "one implementation", "some implementations", "schematic implementation", "example", "specific example", or "some examples", etc., mean that the specific features, structures, materials or characteristics described in the implementations or examples are included in at least one implementation or example of the present disclosure. In this specification, the illustrative expression of the above terms does not necessarily refer to the same implementation or example. Furthermore, the specific features, structures, materials, or characteristics described may be combined in a suitable manner in any one or more implementations or examples.

Although the implementations of the present disclosure have been illustrated and described, it can be understood by those skilled in the art that, various changes, modifications, substitutions and alterations may be made to the implementations without departing from the spirit and scope of the present disclosure. The scope of the present disclosure is determined by the claims and their equivalents.

What is claimed is:

1. An electro-acoustic conversion device, comprising:

a housing provided with a sound chamber and a sound outlet communicating with the sound chamber;

an electro-acoustic component arranged in the sound chamber; and a vibration element fixed to the housing and configured to generate sound waves to atomize liquid entering the sound chamber, to discharge the atomized liquid outside the sound chamber through the sound outlet.

2. The electro-acoustic conversion device of claim 1, wherein the vibration element is further configured to drive the housing to vibrate together when the vibration element vibrates.

3. The electro-acoustic conversion device of claim 2, wherein the sound chamber comprises a rear sound chamber and a front sound chamber communicating with the rear sound chamber, wherein the electro-acoustic component is housed in the rear sound chamber, and the sound outlet communicates with the front sound chamber.

4. The electro-acoustic conversion device of claim 3, wherein the housing comprises a rear housing and a front housing, wherein the rear housing is connected to the front housing, the rear housing encloses the rear sound chamber, and the front housing encloses the front sound chamber; the electro-acoustic component is arranged in the rear housing, and the vibration element is fixed to the front housing.

5. The electro-acoustic conversion device of claim 4, wherein the front housing comprises a vibration sheet opposite to a sound emitting side of the electro-acoustic component, wherein the vibration element is fixed to the vibration sheet.

6. The electro-acoustic conversion device of claim 5, wherein the vibration element is a piezoelectric ceramic piece.

7. The electro-acoustic conversion device of claim 6, wherein the vibration sheet is a steel sheet.

8. The electro-acoustic conversion device of claim 4, wherein the vibration element is located within the front sound chamber or outside the front sound chamber.

9. The electro-acoustic conversion device of claim 4, wherein the sound outlet is formed by a common definition of the front housing and the rear housing.

10. The electro-acoustic conversion device of claim 2, wherein high-frequency sound waves having frequency greater than 6000 Hz are generated during the vibration of the vibration element and the housing; and ultrasonic waves having frequency of 20000 Hz or more are generated during the vibration of the vibration element and the housing.

11. A terminal comprising:

a casing provided with at least one speaker hole; and an electro-acoustic conversion device arranged in the casing, the electro-acoustic conversion device comprising:

a housing provided with a sound chamber and a sound outlet communicating with the sound chamber, wherein the sound outlet is in communication with the speaker hole;

an electro-acoustic component arranged in the sound chamber; and a vibration element fixed to the housing and configured to generate sound waves to atomize liquid entering the sound chamber, to discharge the atomized liquid outside the sound chamber through the sound outlet.

12. The terminal of claim 11, wherein the terminal comprises:

a detection module configured to detect whether there is liquid in the sound chamber; and a processor configured to control the vibration element to vibrate to generate sound waves in response to a determination that there is liquid in the sound chamber, to atomize the liquid in the sound chamber.

13. The terminal of claim 12, wherein the detection module is configured to detect an impedance curve of the electro-acoustic component, determine whether the impedance curve matches a preset impedance curve, and determine that there is liquid in the sound chamber in response to a determination that the impedance curve does not match the preset impedance curve.

14. The terminal of claim 11, wherein the vibration element is further configured to drive the housing to vibrate together when the vibration element vibrates.

15. The terminal of claim 14, wherein the sound chamber comprises a rear sound chamber and a front sound chamber communicating with the rear sound chamber, wherein the electro-acoustic component is housed in the rear sound chamber, and the sound outlet communicates with the front sound chamber.

16. The terminal of claim 15, wherein the housing comprises a rear housing and a front housing, wherein the rear housing is connected to the front housing, the rear housing encloses the rear sound chamber, and the front housing encloses the front sound chamber; the electro-acoustic component is arranged in the rear housing, and the vibration element is fixed to the front housing.

17. The terminal of claim 16, wherein the front housing comprises a vibration sheet opposite to a sound emitting side of the electro-acoustic component, wherein the vibration element is fixed to the vibration sheet.

18. The terminal of claim 17, wherein the vibration element is a piezoelectric ceramic piece.

19. The terminal of claim 18, wherein the vibration sheet is a steel sheet.

20. The terminal of claim 16, wherein the vibration element is located within the front sound chamber or outside the front sound chamber.

* * * * *